United States Patent [19]

Watanabe et al.

[11] Patent Number: 4,551,596

[45] Date of Patent: Nov. 5, 1985

[54] SURGE-ABSORBERLESS VACUUM CIRCUIT INTERRUPTER

[75] Inventors: Ryuji Watanabe, Toukai; Hisashi Ando, Hitachi; Keiichi Kuniya, Hitachi; Yukio Kurosawa, Hitachi, all of Japan

[73] Assignee: Hitachi, Ltd., Tokyo, Japan

[21] Appl. No.: 478,306

[22] Filed: Mar. 24, 1983

[30] Foreign Application Priority Data

Mar. 26, 1982 [JP] Japan ..... 57-47423

[51] Int. Cl.[4] ..... H01H 33/66

[52] U.S. Cl. ..... 200/144 B; 200/264

[58] Field of Search ..... 200/144 R, 144 B, 264, 200/265, 266; 423/509

[56] References Cited

U.S. PATENT DOCUMENTS 3,596,027 7/1971 Okutomi et al. ..... 200/144 B
3,843,856 10/1974 Attia ..... 200/144 B
4,424,429 1/1984 Yamanaka et al. ..... 200/264

FOREIGN PATENT DOCUMENTS 0042152 12/1981 European Pat. Off. .
2050060A 12/1980 United Kingdom .

OTHER PUBLICATIONS

Kurtz et al., "General Guidelines for Vacuum Circuit Breaker Application", in *IEEE Transactions on Industry Applications* (Jul./Aug., 1972), pp. 412–417.

*Primary Examiner*—J. R. Scott
*Assistant Examiner*—Morris Ginsburg
*Attorney, Agent, or Firm*—Antonelli, Terry & Wands

[57] ABSTRACT

A small-sized, light weighted vacuum circuit interrupter is provided. The interrupter comprises a vacuum container confining a vacuum atmosphere of a pressure less than $10^{-5}$ mmHg and a pair of electrodes at least one of which is a movable electrode for making and breaking an electric circuit including either a transformer of a rated surge voltage strength of less than 45 kV or a motor of a rated surge voltage strength of less than 25 kV. At least one of the electrodes has a contact made of a porous body of a refractory conductive material and an impregnate selected from the group consisting of silver telluride, silver selenide and mixtures thereof impregnated in the porous body in an amount sufficient to give the interrupter a chopping current of not more than 1A and an arc extinguishing capability at 1MHz of not more than 27 A/μs when measured in a circuit of 6 kV. The interrupter can be connected to the load without a surge absorber for protecting the breaker from a surge voltage generated at the time of interrupting the circuit.

16 Claims, 3 Drawing Figures

SURGE-ABSORBERLESS VACUUM CIRCUIT INTERRUPTER

FIELD OF THE INVENTION

This invention relates to a vacuum circuit interrupter which is usable as a surge-absorberless vacuum circuit interrupter having an electrode contact of low surge voltage characteristics. Since the vacuum circuit interrupter of the invention needs no surge-absorber, the vacuum circuit interrupter assembly can be made small and light-weight.

BACKGROUND OF THE INVENTION

Materials that have been believed suitable for use in the electrodes of low surge type vacuum circuit interrupters include Cu-based alloys of low melting, high vapor pressure elements such as Bi, Pb, Te, Se and the like, and Ag-WC series alloys and Cu-W series alloys, both being produced by powder metallurgy technique. The former Cu-based alloys exhibit an excellent low surge voltage characteristic at the initial stage before repetition of breakings. But, when an interrupting current is as large as a short-circuited current, Bi, Pb and the like in the Cu matrix oozes out or evaporation occurs so that the alloy thereafter loses its low surge voltage characteristics. Due to oozing of the low melting, high vapor pressure elements, it is inevitable that the dielectric strength and large current breaking capability is remarkably reduced. Hence, various problems occur in putting these alloys to practical application. The latter alloys such as the Ag-WC series alloys and the Cu-W series alloys also exhibit relatively good low surge voltage characteristics. Among them, the Ag-WC series alloys have good low surge voltage characteristics even after breaking a large current such as a short-circuited current. However, this material involves the problem that it can not break a relatively large current and there is a limit in increasing its capability.

The low surge voltage characteristics will be described in further detail. None of the above-mentioned Cu-based alloys, the Ag-WC series alloys and the Cu-WC series alloys can completely satisfy the low surge voltage characteristics. The low surge voltage characteristics are determined by whether or not the material can minimize the chopping current value at the time of breaking a small current in a vacuum circuit breaker. It is preferred that the material can make the value zero ampere. Practically, however, it is not possible to make it zero. In this sense, the value of about 1 to about 3A has been conventionally used to represent the low surge voltage characteristics, though the value may change depending upon the experimental condition. However, this chopping current value results in an allowable surge voltage for loads having high dielectric strength such as a rotary machine (motors) and a transformer but it is yet too high for loads having low dielectric strength such as a dry type transformer and is likely to cause dielectric breakdown. In designing various reception and distribution equipments, it has been difficult to attain completely surge-absorberless vacuum circuit breakers by use of the conventional low surge voltage vacuum circuit breakers. In other words, the low surge voltage vacuum circuit breakers have been made most of only in the limited application or only for a load system having high dielectric strength.

Among the factors that determine the low surge voltage characteristics, the chopping current characteristics inherent to the electrode material are the most dominant. Generally, the above-mentioned switching surge voltage V can be expressed as $V \approx P \cdot Is \cdot Z$ where Is is a chopping current value of an electrode material, Z is a surge impedance of a load machine and P is the damping constant dependent on the load, and $\approx$ means "nearly equal to". In order to prevent dielectric breakdown of the dry type transformer or the like in the light of this relation, it is necessary to reduce the chopping current value Is to the order of 1A and preferably, below 1A. Accordingly, the conventional material is not satisfactory for the surge-absorberless vacuum circuit breaker.

SUMMARY OF THE INVENTION

It is therefore an object of the present invention to provide a vacuum circuit interrupter or breaker provided with an electrode contact of low surge voltage characteristics, which interrupter is a surge-absorberless vacuum circuit interrupter or breaker.

There is provided a vacuum circuit interrupter of the type which is free of a surge-absorber, comprising a vacuum container and a pair of electrodes disposed inside the container, wherein at least one of the electrodes has a contact made of an alloy of low surge voltage characteristics. The contact alloys may be made of a porous body of a refractory conductive material and a compound of selenium or tellurium and silver or may be made only of the compound of silver and tellurium or selenium.

According to the present invention, there is provided a vacuum circuit interrupter comprising a vacuum container confining a vacuum atmosphere of a pressure less than $10^{-5}$ mmHg and a pair of electrodes at least one of which is a movable electrode for making and breaking an electric load circuit including either a transformer of a rated surge withstand voltage of less than 45 kV or a motor of a rated surge withstand voltage of less than 25 kV, wherein at least one of said electrodes is provided with a contact of an alloy of low surge voltage characteristics, said interrupter having a chopping current of not more than 1A and an arc extinguishing capability of not more than 27 A/μs when measured in a circuit of 6 kV. Particularly, when the interrupter of the invention has a rated voltage of at least 3 kV and an impulse discharge voltage strength of at least 45 kV, said interrupter can be easily made free of a surge absorber for protecting said load circuit from a surge voltage generated by interruption of said load circuit. The arc extinguishing capability may vary in accordance with the potential of a load circuit. The higher the potential, the smaller the capability becomes.

The contact can be made of silver selenide, silver telluride or a mixture thereof. Further, the contact material is made of a porous body of a refractory conductive material and an impregnate in said porous body, wherein the impregnate is a member selected from the group consisting of silver selenide, silver telluride and mixtures thereof. The refractory conductive material is a member selected from the group consisting of cobalt, iron, nickel, tungsten, molybdenum, tantalum, tungsten carbide, molybdenum carbide, tantalum carbide and mixtures thereof.

Preferably, the contact material consists essentially of said refractory conductive material and the impregnate mentioned above. This contact material is substantially free from metallic silver.

The porous body is preferably made of a sintered body of powder as said refractory conductive material.

The impregnate preferably consists essentially of a member of said silver telluride, silver selenide and the mixture thereof.

A preferable contact alloy consists essentially of 20 to 80% by weight of said refractory conductive material and 80 to 20% by weight of said impregnate.

A vacuum circuit interrupter employing the contact materials should have an interruption capability of not less than 100%, based on that of the breaker provided with a conventional contact of a 70 weight % tungsten carbide and 30 weight % silver alloy.

DETAILED DESCRIPTION OF PREFERRED EMBODIMENTS

The present inventors have found that a vacuum circuit breaker with no surge-absorber can be obtained by employing a contact material having low surge voltage characteristics. When a vacuum circuit breaker employing the contact material exhibits a maximal chopping current ($i_o$) of not larger than 1.0A and a high frequency arc extinguishing capability (di/dt) of not larger than 27 A/μs, the circuit breaker can be used without a surge absorber in a load circuit including either a transformer of a rated surge withstand voltage of less than 45 kV or a motor of a rated surge withstand voltage of less than 25 kV.

The arc extinguishing capability di/dt is determined by the following equation:

$$(di/dt) = \underline{Is} \times 3 \times 2\sqrt{2} \times \pi \cdot \underline{f}$$

where Is is an interrupting capability (A) in a high frequency circuit of 6 kV and f is the test frequency (1 MHz). The equation represents a relationship between di/dt and Is in a three phase-alternating current circuit having a dry type (oil-less) transformer or an induction motor.

The tests for determining di/dt, chopping current, etc were conducted by using a conventional testing apparatus equipped with an evacuating means to evacuate a vacuum vessel to about $10^{-7}$ mmHg. A contact body made of, such as, Co sintered body impregnated with $Ag_2Se$ which has a diameter of 20 mm was screwed to the top of each of a pair of copper electrodes.

In order to obtain the interrupting capability of the conventional 30%Ag–70%WC contact, the contact having a diameter of 20 mm was soldered to the top of each of a pair of copper electrodes.

Particularly, when the high frequency arc extinguishing capability is not larger than 20 A/μs, the interrupter can be safely used without installing a surge absorber thereto.

When a high frequency interrupting capability is not larger than 0.7 A, the interrupter exhibits excellent performance without a surge absorber.

Figure 3:
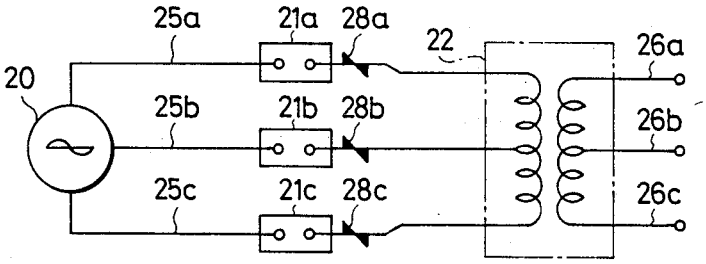
PRIOR ART FIG. 3
FIG. 3 is a schematic diagram of a circuit including vacuum interrupters and a load transformer.

FIG. 3 is a schematic diagram of an electrical circuit comprising a power source 20, vacuum circuit interrupters 21*a*, 21*b*, 21*c*, surge voltage absorbers 28*a*, 28*b*, 28*c*, and a transformer 22. The interrupters are connected to cables 25*a*, 25*b*, 25*c* and to the transformer through the surge voltage absorbers. In the tests of interrupters terminals 26*a*, 26*b*, 26*c* are open. In the conventional interrupters the surge absorbers for protecting the transformer having a rated surge voltage resistance of 45 kV or less or a motor having a rated surge voltage resistance of 25 kV or less were necessary.

According to the present invention, there is no need to insert surge voltage absorbers between the interrupters and the induction load.

When the circuit breaker satisfies the following characteristics, well balanced vacuum circuit breakers are provided:

(1) A rated voltage is 3 kV or more.
(2) An interrupting current is 2 kA or more.
(3) An impulse dielectric strength is 45 kV or more.
(4) An interrupting capability is more than 100%, based on a conventional 30% Ag-70% WC contact.

In the present invention, the chopping current value at the time of interruption of a small current is set below 1 A as the target so as to obtain the electrodes that serve completely as the surge-absorberless vacuum circuit interrupters. The present inventors previously found that low surge type electrodes could be obtained by the sintered body of an element of the Fe group impregnated with a molten Ag alloy. Though this molten impregnated alloy electrode has a lower chopping current than the conventional Ag-WC electrode and provides excellent surge voltage characteristics, the chopping current is still from about 1 A about 2A and it is difficult to obtain the target value of below 1 A.

As a result of intensive studies, the present inventors have discovered that the low surge voltage characteristics of these materials are controlled neither by the Fe group element as the matrix nor by Te or Se alone that is added to the matrix. In other words, it is the compound itself between Ag and Te or between Ag and Se, i.e., $Ag_2Te$ or $Ag_2Se$, that exhibits the low surge voltage effect. According to a series of experiments carried out by the present inventors, the low surge property remains substantially equal to the conventional alloy if the phases are great in which Ag or Te and Se crystallizes alone and the chopping current value of about 1 to about 2 A is seen. If the alloy composition consists principally of the composition of a compound of $Ag_2Te$ or $Ag_2Se$ such as Ag-37 wt% Te or Ag-27 wt% Se, however, the chopping current value becomes below 1 A.

Accordingly, the inventors of the present invention first bonded these compounds to an electrode support made of Cu in a predetermined electrode structure and then examined their electric properties. It was thus found that the maximal values of the chopping current were 0.9 A and 0.7 A for the $Ag_2Te$ electrode and the $Ag_2Se$ electrode. It was also confirmed that the dielectric strength and large current interruption capability of interrupters using these electrodes were sufficiently comparable to those of the conventional material. The structure in which the compound described above was bonded to a Cu electrode support could be used sufficiently practically unless particularly large capacity was required.

To improve the dielectric strength and to increase the capacity, the present inventors further attempted to impregnate the powder sintered porous body of a refractory conductive material such as Fe, Ni, Co, Mo, Ta, W, MoC, Wc, or TaC with the molten compound described above. When a Co sintered porous body was impregnated with 50 wt% of $Ag_2Se$, for example, the maximal chopping current could be reduced by 1.0 A and by 0.5 A on an average. It was also found that the dielectric strength was improved by about 20%, compared with 30%Ag–70%WC contact and the interrupting capacity for large current was also improved. When the sintered porous bodies of W, Ta and Mo were likewise impregnated with the molten compound, the similar trend was also observed. Taken altogether, these materials were found superior in performance to the conventional Ag-WC contact materials.

EXAMPLE 1

Figure 1:
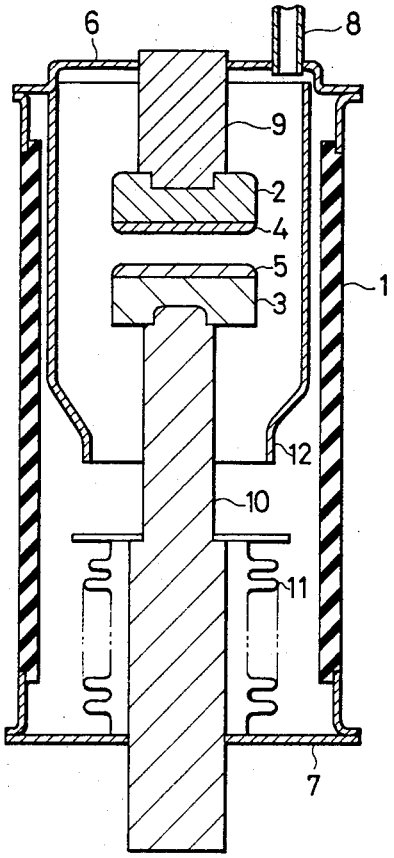
FIG. 1 is a sectional view showing the construction of the vacuum valve for the vacuum circuit interrupter or breaker in accordance with the present invention.

The vacuum valve of the vacuum breaker in accordance with the present invention had a structure such as shown in FIG. 1, by way of example. The cylindrical case 1 was made of an insulating material such as ceramic or crystallized glass and both of its ends were fixed by metal terminal plates 6 and 7. A pair of electrodes, that is, a fixed electrode 4 and a moving electrode 5 capable of moving via bellows 11, were disposed inside the case 1. The interior of the case 1 was evacuated to a pressure of at least $10^{-5}$ mmHg, particularly at least $10^{-7}$ mmHg by an evacuating pipe 8 disposed on the terminal plate 6 and after sufficient evacuation, the tip was air-tightly chipped off. A cylindrical shield 12 was disposed so as to encompass the electrodes 4 and 5. The shield 12 served also as a wall that received the evaporation and spattering of the electrode material when the material was evaporated and spattered by the breaking arc, and thus prevented the material from attaching to the other portions. The electrodes 4 and 5 were bonded to auxiliary electrodes 2 and 3 of Cu by brazing. The electrodes of the invention were the chips. The electrode chip was produced by charging 1 kg of a 73:27 mixture (weight ratio) of granular Ag and Se into a graphite crucible, then vacuum-sealing it into a silica tube of a 50 mm in diameter and heating the tube at 1,000° C. for 30 minutes. Substantially the whole of this alloy consisted of the $Ag_2Se$ compound. This compound was machine-worked in a diameter of 40 mm and a thickness of 3 mm and was then vacuum-brazed on the auxiliary electrodes 2 and 3.

Various electric performance tests were then made for the vacuum valve equipped with the electrodes and having the construction described above. It was found that the interrupter had a chopping current of 0.7 A at most and 0.3 A on an average in a 100 V test circuit and thus had extremely excellent low surge characteristics. It was also confirmed that the withstand voltage as well as the large current interrupting performance of this vacuum valve were sufficiently comparable to those of the conventional Cu-Pb type alloy breaker. When the interrupter was electrically connected as a vacuum circuit interrupter having 7.2 kV and 12.5 kA ratings directly to various motors having a rated surge withstand voltage of less than 25 kV and transformers having a rated surge withstand voltage of less than 45 kV and was then subjected to the three-phase load tests, no dielectric breakdown of the loads due to the surge voltage of small current interruption occurred and sufficient low surge characteristics were ensured.

EXAMPLE 2

In Example 1 the contacts for electrodes were the $Ag_2Se$ compound. This example intends to add greater amounts of the $Ag_2Se$ or $Ag_2Te$ compound to various refractory conductive materials in order to improve the withstand voltage more than the electrode of Example 1 and to additionally provide the large current interrupting performance and consumption resistance.

Figure 2:
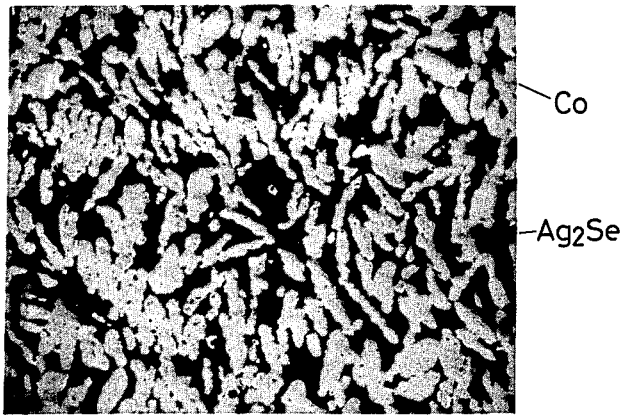
FIG. 2 is a micrograph of the section of a 50% Co-50% $Ag_2Se$ molten and impregnated alloy (125X)

As illustrated in the following Table, the Fe group elements, W, Mo, Ta and their carbides were used. Powders of the refractory conductive materials were shaped by compression and sintered at a predetermined temperature so that they had a porosity of as high as 30 to 50%. The sintered bodies were then impregnated with the molten $Ag_2Se$ or $Ag_2Te$ compound prepared in the same way as in Example 1. Though the conditions such as the temperature and time for melting and impregnation were different, melting and impregnation of $Ag_2Se$ and $Ag_2Te$ could be made smoothly. FIG. 2 shows a microscopic structure of the electrode formed by impregnating the Co sintered body having 50% porosity with the molten $Ag_2Se$. White particles represent Co and the dark black, $Ag_2Se$.

To examine the electric performance, each impregnation material was machined in a test electrode contact of 20 mm in diameter, was fitted to a holder in an evacuation set so as to define a 2.5 mm gap and was highly degassed and baked at 300° C. Thereafter, a high voltage of maximum 60 kV was applied between the electrodes to clean the electrode contact surface.

| No. | Contact material (wt %) | Chopping current in 100 V circuit (A) Maximum | Average | Chopping current ($i_0$) in 6 kV circuit (A) | Interruption capability (%) | Arc-extinguishing capability (di/dt) (A/μs) |
|---|---|---|---|---|---|---|
| 1 | $Ag_2Se$ 100% | 0.7 | 0.3 | 0.5 | 105 | 13.4 |
| 2 | $Ag_2Te$ 100% | 0.9 | 0.4 | 0.7 | 108 | 18.7 |
| 3 | 70% Co—30% $Ag_2Se$ | 1.1 | 0.6 | 0.9 | 125 | 24.0 |
| 4 | 50% Co—50% $Ag_2Se$ | 1.0 | 0.5 | 0.6 | 120 | 16.0 |
| 5 | 50% Co—50% $Ag_2Te$ | 1.3 | 0.9 | 0.9 | 150 | 24.0 |
| 6 | 60% Fe—40% $Ag_2Se$ | 1.5 | 0.9 | 1.0 | 145 | 26.7 |
| 7 | 60% Ni—40% $Ag_2Se$ | 1.5 | 0.9 | 1.0 | 148 | " |
| 8 | 60% W—40% $Ag_2Se$ | 1.7 | 0.8 | 1.0 | 115 | " |
| 9 | 60% Mo—40% $Ag_2Se$ | 1.6 | 0.9 | 1.0 | 120 | " |
| 10 | 90% Ta—10% $Ag_2Se$ | 1.7 | 0.9 | 1.0 | 110 | " |
| 11 | 60% W—40% $Ag_2Te$ | 1.7 | 0.9 | 1.1 | 109 | 29.4 |
| 12 | 60% TaC—40% $Ag_2Se$ | 1.5 | 0.9 | 1.0 | 102 | 26.7 |
| 13 | 60% WC—40% $Ag_2Te$ | 1.0 | 0.7 | 1.0 | 107 | " |
| 14 | 60% MoC—40% $Ag_2Se$ | 1.3 | 0.9 | 1.0 | 105 | " |
| 15 | 80% Co—10% Ag—10% Te | 2.30 | 1.25 | 1.6 | 150 | 42.7 |

-continued

| No. | Contact material (wt %) | Chopping current in 100 V circuit (A) Maximum | Average | Chopping current ($i_o$) in 6 kV circuit (A) | Interruption capability (%) | Arc-extinguishing capability (di/dt) (A/μs) |
|---|---|---|---|---|---|---|
| 16 | 40% Co—50% Ag—10% Te | 1.90 | 0.90 | 1.3 | 170 | 34.7 |
| 17 | 40% Co—50% Ag—10% Se | 1.80 | 0.85 | 1.2 | 170 | 32.0 |
| 18 | 40% Ni—50% Ag—10% Se | 1.90 | 1.00 | 1.3 | 120 | 34.7 |
| 19 | 90% WC—50% Ag—10% Se | 1.60 | 0.80 | 1.1 | 105 | 29.4 |
| 20 | 40% Co—30% Ag—30% Se | 1.40 | 0.95 | 1.1 | 103 | " |
| 21 | 40% Co—30% Ag—30% Te | 1.50 | 0.90 | 1.1 | 103 | " |
| 22 | 20% Co—20% Ag—60% Te | 1.25 | 0.85 | 1.1 | 101 | " |
| 23 | 60% Ag—40% WC | 2.6 | 1.5 | 1.3 | 90 | 34.7 |
| 24 | 30% Ag—70% WC | 2.3 | 1.0 | 1.8 | 100 | 48.0 |
| 25 | 90% Cu—10% BiPb (Bi/Pb = 42/58) | 2.5 | 1.4 | 2.3 | 120 | 61.4 |

The chopping current and the interruption performance were measured, while evacuating the vacuum container to a pressure of $10^{-7}$ mmHg.

Among the contact materials shown in Table above, Nos. 1–9 and Nos. 12–14 satisfy the requirements of the maximal chopping current ($i_o$) and the high frequency arc-extinguishing capability (di/di). Accordingly, these contact materials can preferably be employed in surge-absorberless vacuum circuit interrupters. The measurement of the chopping current was carried out in such a manner that a current was adjusted so as to generate the maximal chopping current when a small current of below 10 A was interrupted by a 100 V circuit of about 50 Hz. The chopping current at the time of interruption of this small current was measured 100 times so as to obtain the maximal value and the average value. The interruption capacity test was carried out to determine the critical breaking current wherein breaking was effected by applying a high voltage of 6 to 7 kV and about 50 Hz to the interrupter while increasing the breaking current stepwise to about 500 A. Evaluation was expressed by a percentage to the critical breaking current of the breaker using the 30%Ag–70%WC sintered electrode of the conventional material. The results of these tests are shown in the Table.

As can be seen from the Table, all the materials of the present invention have excellent low surge voltage characteristics. It has been confirmed that the material consisting of $Ag_2Se$ or $Ag_2Te$ alone has especially excellent low surge voltage characteristics and improved large current interrupting performance. It has also been found that the withstand voltage and consumption resistance are further improved, though they are not shown in the Table, and the materials can be used as the practically effective electrode contact materials.

In accordance with the present invention, the electrode contact having the maximal chopping current value in the order of 1 ampere or less can be obtained. Accordingly, a surge absorber as protection for loads having low dielectric strength such as a dry type transformer or induction motors can be eliminated so that the interrupter can be made a surge absorberless vacuum breaker. Accordingly, the small size and light weight that are inherent to the vacuum breaker can be further improved.

What is claimed is:

1. A vacuum circuit interrupter comprising a vacuum container confining a vacuum atmosphere of a pressure less than $10^{-5}$ mmHg and a pair of electrodes at least one of which is a movable electrode for making and breaking an electric load circuit including either a transformer of a rated surge voltage strength of less than 45 kV or a motor of a rated surge voltage strength of less than 25 kV, wherein at least one of said electrodes is provided with a contact of an alloy of low surge voltage characteristics, said alloy consisting essentially of a porous body of a refractory conductive material and an intermetallic compound selected from the group consisting of silver telluride, silver selenide, and mixtures thereof, and being substantially free of free silver, impregnated in said porous body, said interrupter having a chopping current of not more than 1A and a high frequency arc extinguishing capability of not more than 27 A/μs when measured in a circuit of 6 kV, whereby said interrupter can operate in said electric load circuit without a surge absorber for protecting the load in the load circuit from a surge voltage generated at the time of breaking said electric load circuit.

2. A vacuum circuit interrupter according to claim 1, wherein the interrupter has a rated voltage of at least 3 kV and an impulse discharge voltage strength of at least 45 kV.

3. A vacuum circuit interrupter according to claim 1, wherein the arc extinguishing capability is not larger than 20 A/μs.

4. A vacuum circuit interrupter according to claim 1, wherein the chopping current is not larger than 0.7A.

5. A vacuum circuit interrupter according to claim 1, wherein said refractory conductive material is a member selected from the group consisting of cobalt, iron, nickel, tungsten, molybdenum, tantalum, tungsten carbide, molybdenum carbide, tantalum carbide and mixtures thereof.

6. A vacuum circuit interrupter according to claim 1, wherein said porous body is made of a sintered body of said refractory conductive material.

7. A vacuum circuit interrupter according to claim 1, wherein said alloy consists essentially of 20 to 60% by weight of said refractory conductive material and 80 to 40% by weight of said impregnate.

8. A vacuum circuit interrupter according to claim 1, wherein said interrupter has an interrupting capability of not less than 100%, based on that of the interrupter provided with a conventional contact of a 70 weight % tungsten carbide and 30 weight % silver alloy.

9. A vacuum circuit interrupter according to claim 1, wherein said alloy is substantially free of free tellurium and selenium.

10. A vacuum circuit interrupter comprising a vacuum container confining a vacuum atmosphere of a pressure less than $10^{-5}$ mmHg and a pair of electrodes at least one of which is a movable electrode for making and breaking an electric circuit including either a transformer of a rated surge withstand voltage of less than 45 kV or a motor of a rated surge withstand voltage of less than 25 kV, wherein at least one of said electrodes has a contact made of a porous body of a refractory conductive material and an alloy selected from the group consisting of silver telluride, silver selenide and mixtures thereof impregnated in said porous body, said contact being substantially free of free silver, said alloy being impregnated in an amount sufficient to give said interrupter a maximal chopping current ($i_o$) of not more than 1A and an arc extinguishing capability of 1 MHz of not more than 27 A/$\mu$s when measured in a circuit of 6 kV, said interrupter being connected to a load without a surge absorber for protecting said load from a surge voltage generated at the time of breaking said circuit.

11. A vacuum circuit interrupter which is free of a surge absorber for protecting an electric circuit including a load having an induction coil from a surge voltage generated at the time of breaking, said load having a rated surge withstand voltage of not higher than 45 kV when the load is a transformer or of not higher than 25 kV when the load is a motor, said interrupter comprising a vacuum container confining a vacuum atmosphere of a pressure of less than $10^{-5}$ mmHg and a pair of electrodes, disposed in said container for making and breaking the electric circuit, at least one of the electrodes being movable, at least one of said electrodes having a contact made of an alloy consisting essentially of a refractory metal porous block and a selenide of silver, a telluride of silver, or mixtures thereof, said alloy being substantially free of free silver, said alloy being impregnated in said block and free of gas, wherein said circuit interrupter has a rated voltage of at least 3 kV, an interrupting capability of at least 2 kA, an impulse discharge voltage of at least 45 kilovolts, a maximal chopping current ($i_o$) of not more than 1 A and a high frequency arc-extinguishing capability (di/dt) of not more than 27 A/$\mu$s at 1 MHz to thereby enable said interrupter to operate in said electric circuit, including a load, free of said surge absorber.

12. A vacuum circuit interrupter according to claim 11, wherein said alloy consists essentially of 20 to 60% by weight of said refractory metal porous block and 80 to 40% by weight of said impregnate.

13. A vacuum circuit interrupter according to claim 12, wherein said refractory metal porous block is a member selected from the group consisting of cobalt, iron, nickel, tungsten, molybdenum, tantalum, tungsten carbide, molybdenum carbide, tantalum carbide and mixtures thereof.

14. A vacuum circuit interrupter according to claim 13, wherein said alloy is substantially free of free tellurium and selenium.

15. A vacuum circuit interrupter according to claim 11, wherein said alloy is substantially free of free tellurium and selenium.

16. A vacuum circuit interrupter according to claim 10, wherein said contact is substantially free of free tellurium and selenium.

* * * * *